US011421958B1

(12) United States Patent
Rogers et al.

(10) Patent No.: US 11,421,958 B1
(45) Date of Patent: Aug. 23, 2022

(54) HOLSTER WITH PISTOL RETENTION DEVICE

(71) Applicant: Safariland, LLC, Jacksonville, FL (US)

(72) Inventors: William H. Rogers, St. Augustine, FL (US); Dylan Vaccaro, Jacksonville, FL (US)

(73) Assignee: Safariland, LLC, Jacksonville, FL (US)

( * ) Notice: Subject to any disclaimer, the term of this patent is extended or adjusted under 35 U.S.C. 154(b) by 0 days.

(21) Appl. No.: 17/351,576

(22) Filed: Jun. 18, 2021

(51) Int. Cl.
*F41C 33/04* (2006.01)
*F41C 33/02* (2006.01)

(52) U.S. Cl.
CPC ..... *F41C 33/0209* (2013.01); *F41C 33/041* (2013.01); *F41C 33/048* (2013.01); *F41C 33/0263* (2013.01)

(58) Field of Classification Search
CPC .. F41C 33/0209; F41C 33/041; F41C 33/048; F41C 33/0263
See application file for complete search history.

(56) References Cited

U.S. PATENT DOCUMENTS 4,925,075 A 5/1990 Rogers
5,018,654 A 5/1991 Rogers et al.
5,100,036 A * 3/1992 Rogers ..... F41C 33/0209 224/244
5,275,317 A 1/1994 Rogers et al.
6,769,581 B2 8/2004 Rogers et al.
2015/0097011 A1* 4/2015 Clifton, Jr. ..... F41C 33/045 224/269
2018/0142988 A1* 5/2018 Tedder ..... F41C 33/0236
2019/0128640 A1* 5/2019 Shinkle ..... F41C 33/041

* cited by examiner

*Primary Examiner* — Corey N Skurdal
(74) *Attorney, Agent, or Firm* — Kane Kessler, P.C.; Paul E. Szabo

(57) ABSTRACT

A holster, for a pistol that has a top portion and that has a bottom portion including a trigger guard, includes a holster body having a top portion and a bottom portion fixed in position relative to the top portion. The holster body defines a chamber in the holster body for receiving a portion of the pistol. The holster body is made of two holster body pieces that are joined together to form the holster body defining the chamber. The holster also includes a plurality of different pistol retention devices each of which is configured to be mounted inside the chamber of the holster body between the at least two holster body pieces. Each one of the plurality of devices has a mounting portion for securing the device in the chamber of the holster body and having a trigger guard engagement portion for releasably engaging the trigger guard of the pistol. The mounting portions of the plurality of devices are substantially identical to each other whereby any selected one of the plurality of devices can be similarly mounted in a working position inside the chamber of the holster body. The trigger guard engagement portions of the plurality of devices are substantially different from each other thereby to properly releasably engage different pistols having different trigger guards. As a result, the one holster body can accommodate and retain a number of different pistols having different sizes and configurations by mounting an appropriate pistol retention device that is configured for that pistol.

8 Claims, 16 Drawing Sheets

HOLSTER WITH PISTOL RETENTION DEVICE

BACKGROUND OF THE INVENTION

Many handgun (pistol) holsters include a pistol retention device, to help prevent inadvertent withdrawal of the pistol from the holster. The pistol retention device (or "PRD") typically resists, but does not completely block, withdrawal of the pistol from the holster. Typically the PRD has portions that are configured to releasably engage the trigger guard 20 of the pistol, extending around and into the trigger guard 20 opening. This engagement retains the pistol in the holster, but with a firm pull on the grip the user can withdraw the pistol.

Some holsters also include, for safety, a locking mechanism for locking the pistol in the holster—that is, for blocking withdrawal of the pistol from the holster unless the locking mechanism is specifically and intentionally released. In some cases, this locking mechanism is located on the top wall of the holster body, as is the case with the locking mechanism shown in U.S. Pat. No. 6,769,581. For this locking mechanism to work, the pistol is positioned securely against the top wall of the holster body, and the locking mechanism engages the ejection port of the pistol. In this case, the dimensions of the holster are selected to provide a snug fit of the pistol in the holster, in that upward direction (forward if the pistol is being held vertically, as in a holster worn on a belt).

A holster with these dimensions, however, can not accommodate a pistol that is taller (larger in that upward direction). In addition, that holster will not snugly hold a pistol that is shorter; the distance between the holster top wall and the holster bottom wall will be too large. As a result, a different holster needs to be provided for each different sized pistol. Since there are many different pistol models available, a large number of different holsters must be provided, and a dealer, for example, will need to stock many different holsters. Further, each model of pistol may have a different trigger guard 20 configuration, so the pistol retention device also needs to be different. Additionally, some users want holsters that fit inside the waistband ("IWB) rather than outside the waistband ("OWB"), increasing still further the different number of holster models that must be offered for sale.

SUMMARY OF THE INVENTION

In one embodiment, the invention relates to a holster for a pistol that has a top portion and that has a bottom portion including a trigger guard. The holster includes a holster body having a top portion and a bottom portion fixed in position relative to the top portion. The holster body defines a chamber in the holster body for receiving a portion of the pistol. The holster body is made of two holster body pieces that are joined together to form the holster body defining the chamber. The holster also includes a plurality of different pistol retention devices each of which is configured to be mounted inside the chamber of the holster body between the at least two holster body pieces. Each one of the plurality of devices has a mounting portion for securing the device in the chamber of the holster body and having a trigger guard engagement portion for releasably engaging the trigger guard of the pistol. The mounting portions of the plurality of devices are substantially identical to each other whereby any selected one of the plurality of devices can be similarly mounted in a working position inside the chamber of the holster body. The trigger guard engagement portions of the plurality of devices are substantially different from each other thereby to properly releasably engage different pistols having different trigger guards. As a result, the one holster body can accommodate and retain a number of different pistols having different sizes and configurations by mounting an appropriate pistol retention device that is configured for that pistol.

In another embodiment, the invention relates to a method of assembling a holster for a selected pistol. The method includes the steps of providing a first holster body piece; providing a second holster body piece that can be joined to the first holster body piece to form a holster body having a chamber therein for receiving the selected pistol; providing a plurality of different pistol retention devices that can alternatively be mounted in the chamber of the holster body; selecting a pistol retention device that is configured to help to support the selected pistol snugly in the chamber; mounting the pistol retention device to the first holster body piece; providing two pairs of clamps that can alternatively be used to join the first holster body piece to the second holster body piece in either an inside the waistband configuration or an outside the waistband configuration; selecting the desired pair of clamps; and joining the first holster body piece to the second holster body piece with the selected pair of clamps, with the pistol retention device already being mounted to the first holster body piece.

BRIEF DESCRIPTION OF THE DRAWINGS

Further features of the invention will become apparent to one of ordinary skill in the art to which the invent pertains, from a reading of the following description together with the accompanying drawings, in which.

DESCRIPTION OF EMBODIMENTS OF THE INVENTION

The present invention is applicable to handgun holsters of varying configurations. As representative of the invention, the drawings illustrate a handgun holster 10 that is a first embodiment of the invention. The invention is, of course, not limited to the illustrated embodiment, but rather is defined by the claims.

Figure 12:
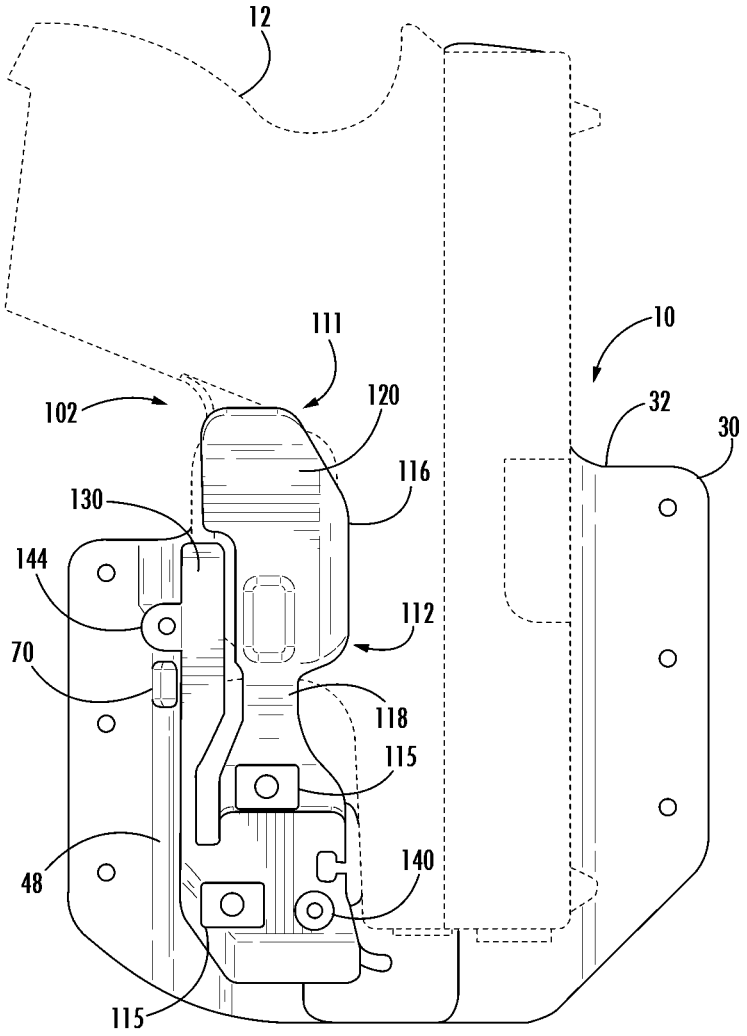
FIG. 12 is a partial schematic view of a holster of the invention showing mounted therein a first model of pistol retention device

The holster 10 is configured for use with a handgun shown schematically at 12. The illustrated handgun (FIG. 12) is a semi-automatic pistol having a grip 14, a barrel 16, a trigger 18, and a trigger guard 20. The trigger guard 20 defines a trigger guard opening 22 in which the trigger 18 is located.

(The terms "top" and "bottom" are not absolute but are used herein for convenience, regardless of the pistol orientation. For example, on an automatic pistol, the slide and ejection port are on the top when the pistol is held in the shooting position, and the trigger guard 20 is on the bottom. Herein, the term "forward" is used also, to indicate a direction or placement toward the muzzle of the pistol 12, and the term "rearward" is used to indicate a direction or placement toward the grip of the pistol 12.

The bottom wall or bottom leg 24 of the trigger guard 20 is the lowest portion of the pistol 12, and thus the height of the pistol 12 is determined between the bottom leg 24 of the trigger guard 20 and the top of the pistol 12. The top of the pistol 12 includes portions indicated schematically at 26 (FIG. 18), such as the ejection port and slide, that are engageable by an optional handgun locking mechanism illustrated schematically at 28 in FIG. 18. The locking mechanism 28 may be of the type shown in U.S. Pat. No. 6,769,581.

The holster 10 (FIG. 1) includes a holster body 30 which accommodates the pistol 12. The holster body 30 is made of two separate pieces joined together, specifically, a first piece 32 and a second piece 34. Together, the two pieces fully accommodate the pistol 12. The second piece 34 (FIGS. 1 and 3) is toward the outside when the holster is being worn, and the first piece 32 (FIG. 2) is toward the inside when the holster is being worn. In the illustrated embodiment, the first piece 32 is made from plastic, and the second piece 34 is made from leather, although that can vary.

The second piece 34 is on the outside of the holster when worn, for appearance and style. This second piece 34 can be formed to be generic (not snug) and does not need to be formed to fit the particular pistol 12 being holstered, because the holster 10 includes a separate securing device, a pistol retention device, as described below in detail.

A pair of clamps 80 or 86 as described below are used to hold the two holster body pieces 32 and 34 together. As described below, the clamps 86 for the IWB setup (that is, when the holster 10 is to be assembled in an inside the waistband configuration) are different from the clamps 80 for the OWB setup (that is, when the holster is to be assembled in an outside the waistband configuration). That difference provides the needed variability in function. In addition, a J-hook 92 (FIG. 1) is used when the holster is set up for IWB use.

Figure 1:
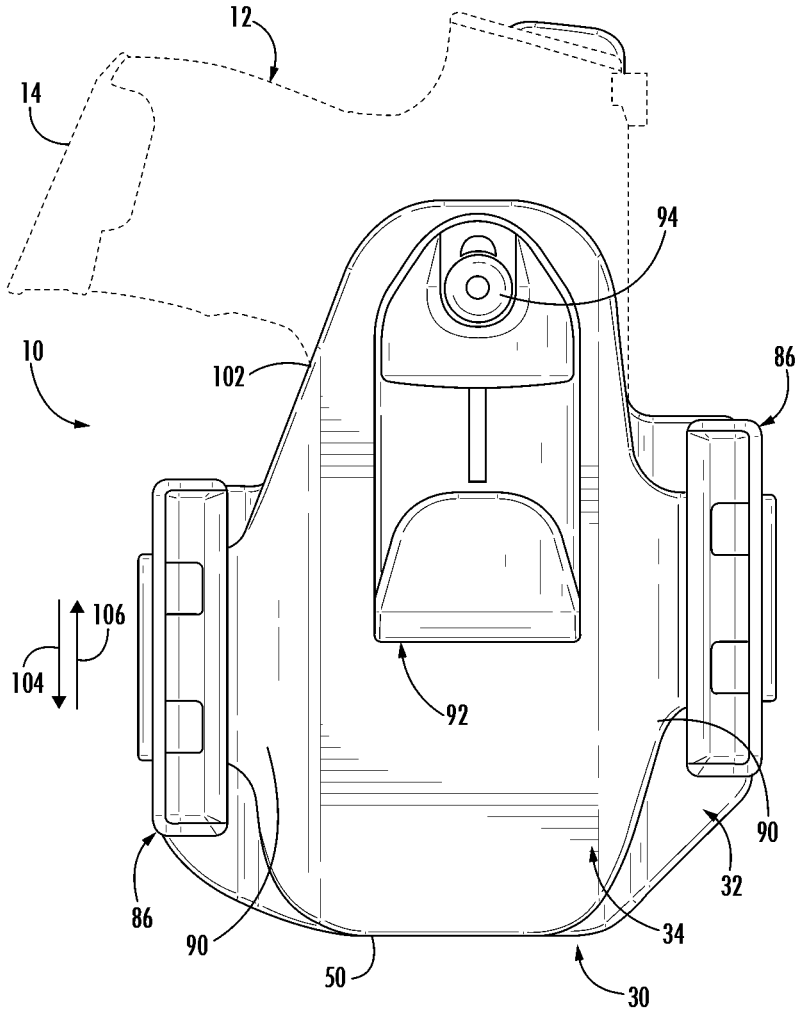
FIG. 1 is an outside elevational view of a holster that is a first embodiment of the invention, configured for wearing inside the user's waistband.
Figure 2:
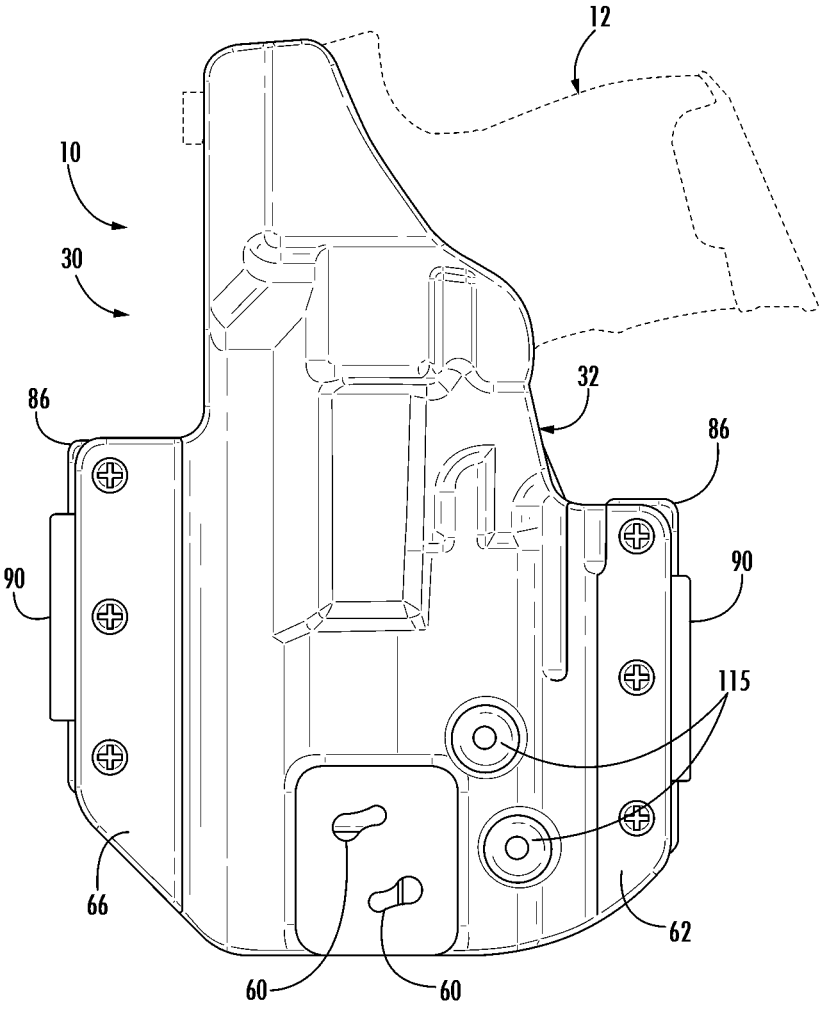
FIG. 2 is an inside elevational view of the holster of FIG. 1.
Figure 3:
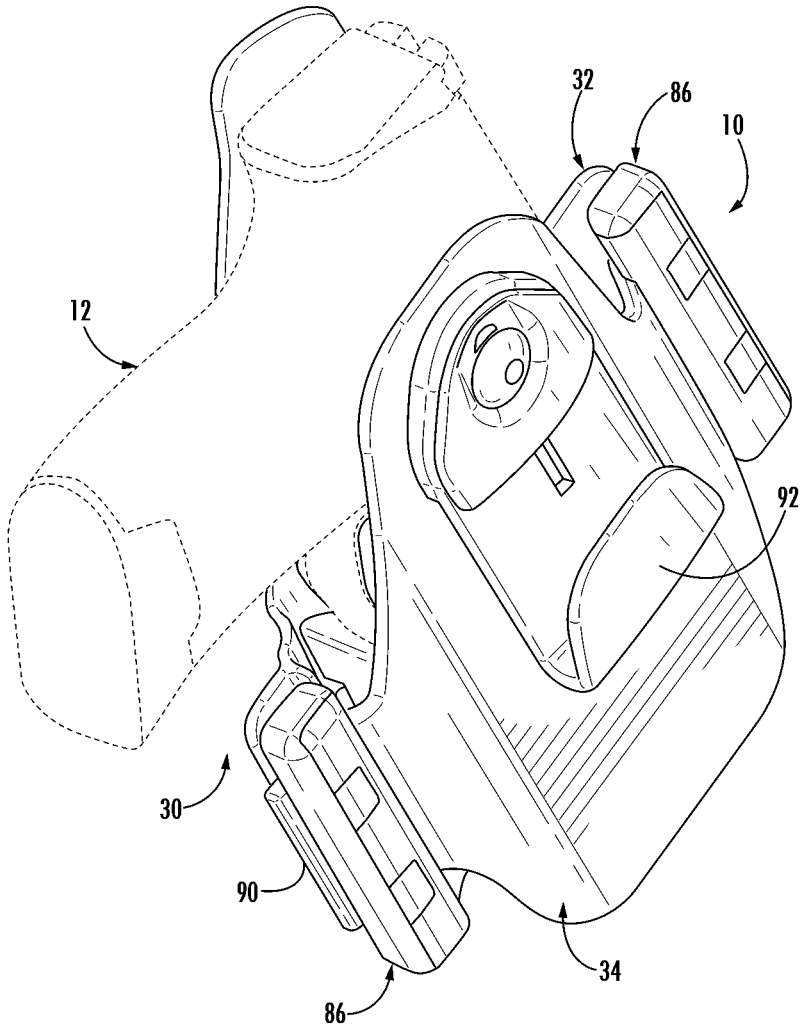
FIG. 3 is an outside perspective view of the holster of FIG. 1.
Figure 4:
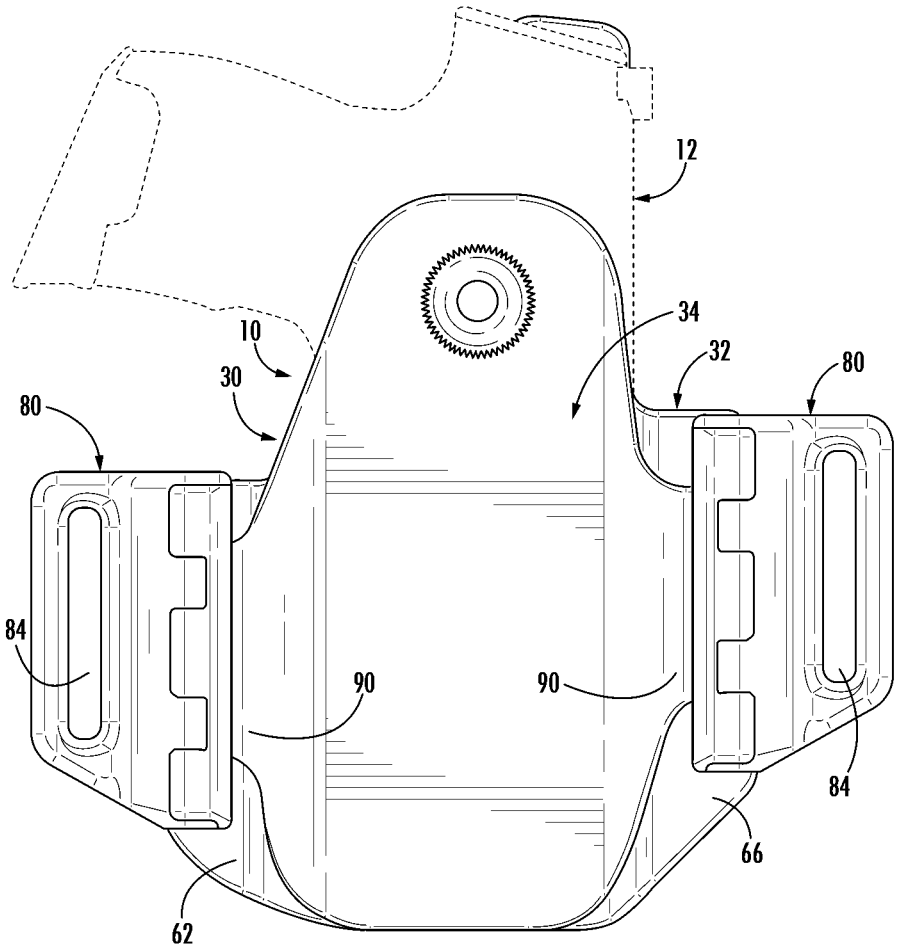
FIG. 4 is an outside elevational view of the holster of FIG. 1, configured for wearing outside the user's waistband.
Figure 5:
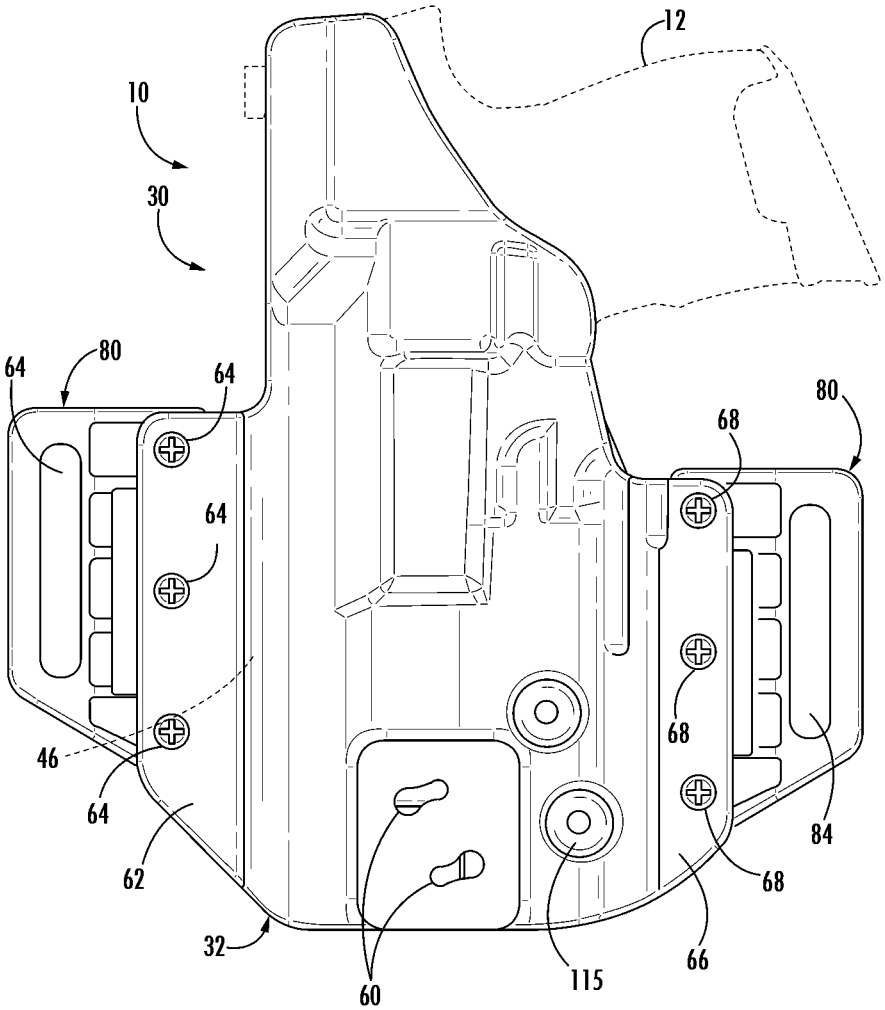
FIG. 5 is an inside elevational view of the holster of FIG. 4.
Figure 6:
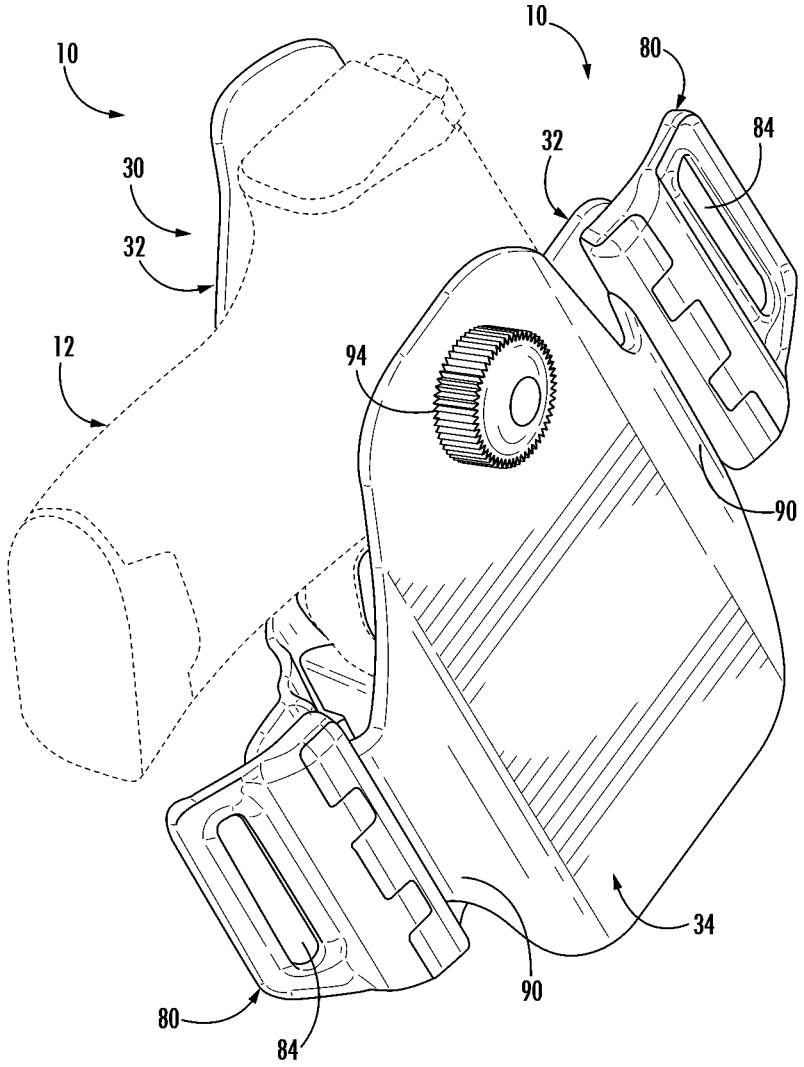
FIG. 6 is an outside perspective view of the holster of FIG. 4.
Figure 7:
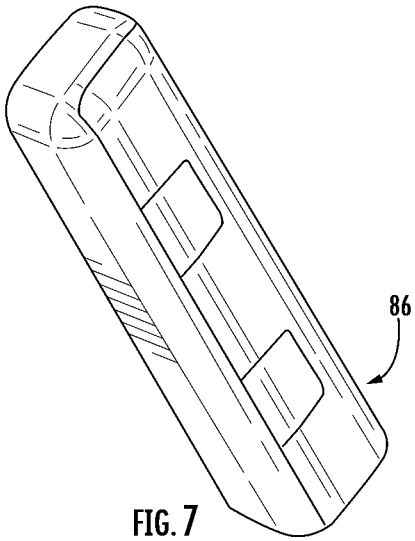
FIG. 7 is a perspective view of a holster part that is used when the holster is configured for wearing inside the waistband.
Figure 8:
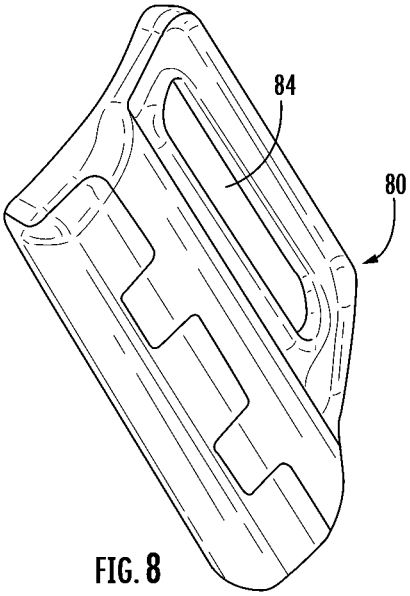
FIG. 8 is a perspective view of a holster part that is used when the holster is configured for wearing outside the waistband.

When assembled, the holster body 30 has two side walls 42 and 44; a top portion or top wall 46; a bottom wall or bottom portion 48; and a forward end wall 50. The first piece 32 forms the inside wall of the holster body 30 (that lies against the user's hip or waist) and is appropriately configured to that end. At the bottom, the first piece 32 has two fastener openings 60 (FIG. 5) for receiving fasteners for mounting the PRD. On the left side as viewed in FIG. 5, the first piece 32 has a left tab 62 with three fastener openings 64 for receiving fasteners for the selected clamp (either an IWB clamp 86 as shown in FIGS. 1-3 or an OWB clamp 80 as shown in FIGS. 4-6). On the right side as viewed in FIG. 5, the first piece 32 has a right tab 66 with three fastener openings 68 for receiving fasteners for the selected clamp. The right tab 66 is the mirror image of the left tab 62.

Figure 18:
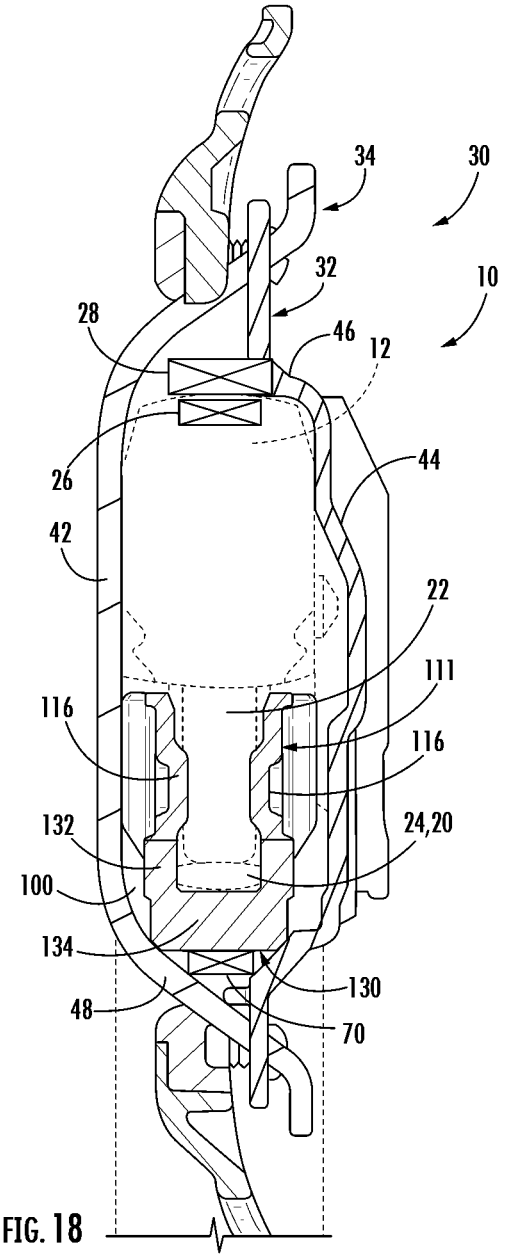
FIG. 18 is a longitudinal sectional view of the holster including a pistol retention device and including a schematically illustrated handgun locking mechanism, showing a pistol in place.

The first piece 32 of the holster body 30 (FIG. 18) has wall portions indicated schematically at 46 that partially define (together with the second piece 34) the top portion or top wall of the holster body 30. In the illustrated holster 10, the holster top wall 46 and side walls 42 and 44 support the pistol locking mechanism that is indicated schematically at 28 (FIG. 18). This locking mechanism 28 engages the pistol 12 adjacent its ejection port, and prevents inadvertent or unwanted removal of the pistol 12 from the holster 10. The present invention is applicable to holsters with or without such locking mechanisms.

Figure 13:
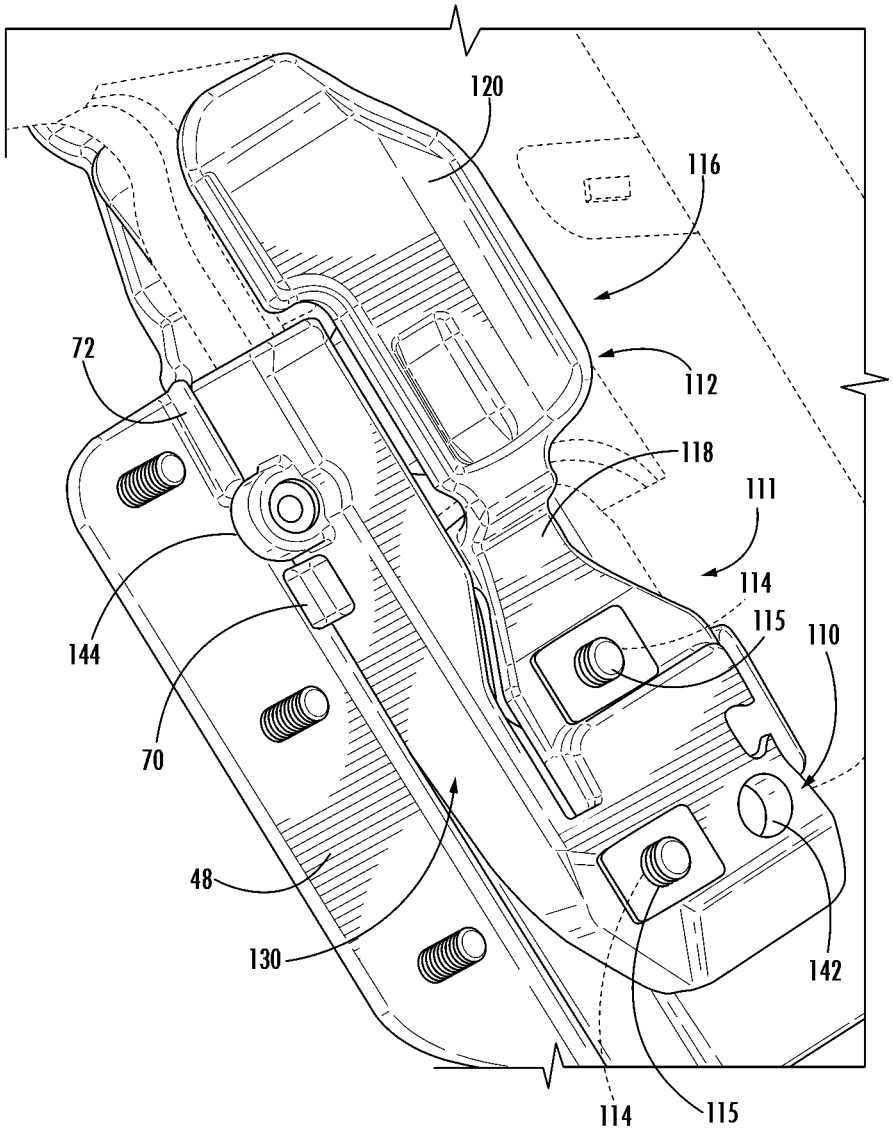
FIG. 13 is a perspective view of the holster and pistol retention device of FIG. 12.

The first piece 32 has wall portions that partially define (together with the second piece 34) the bottom portion or bottom wall 48 (FIG. 13) of the holster body 30. The bottom portion 48 of the holster body 30 has several features that provide engagement surfaces for the pistol 12 trigger guard 20 or for the PRD. A forward tab or element 70 is provided that can engage a bottom arm of selected ones of the PRDs when a shorter pistol 12 is being holstered. A rearward tab or element 72 is provided that can engage the bottom of the trigger guard 20 directly, when a taller pistol 12 is being holstered. The rearward tab 72 is located farther from the top wall 46 of the holster 10, to accommodate this taller pistol 12. The usage of these tabs 70 and 72 is described in more detail below. Also, it should be noted that the functions of the tabs 70 and 72 can be performed by other types of holster body bottom portion structure, such as simple wall portions, etc.; as such, the term is not limited to the illustrated embodiment.

In accordance with one feature of the invention, the one holster body 30, made up of the two pieces 32 and 34, can be configured for use either outside the user's waistband (OWB) or inside the user's waistband (IWB). This variability is accomplished by using the different clamps 80 or 86 to join together the first piece 32 and the second piece 34.

The set of clamps 80 shown in FIGS. 4, 5, 6, and 8 are used to configure the holster for OWB use. Each clamp 80 has three fastener openings (not shown) for receiving fasteners to secure it to either the left tab 62 or the right tab 66 of the first piece 32 of the holster body 30. In that configuration, each clamp 80 has an external belt slot 84 through which the user's belt 85 can be threaded to mount the holster 10 on the user's belt.

The set of clamps 86 shown in FIGS. 1, 2, 3, and 7 are used to configure the holster for IWB use. Each clamp has three fastener openings for receiving fasteners to secure it to either the left tab 62 or the right tab 66 of the first piece 32 of the holster body 30. These IWB clamps 86 do not have a belt slot. In this manner, the user fastens either the OWB clamps 80 or the IWB clamps 86 to the holster body 30 first piece 32, depending on the desired holster usage.

The clamps 80 and 86 serve another function, that is, securing the holster body second piece 34 to the holster body first piece 32. The holster body second piece 34 has two tabs or flanges 90 (FIG. 1) that project laterally. These flanges 90 are clamped between the first piece tabs 62 and 66 and the selected set of clamps 80 or 86, when the clamps are fastened to the first piece 32. As a result, the first piece 32 is secured to the second piece 34, and the holster body 30 is thus completed.

Figure 9:
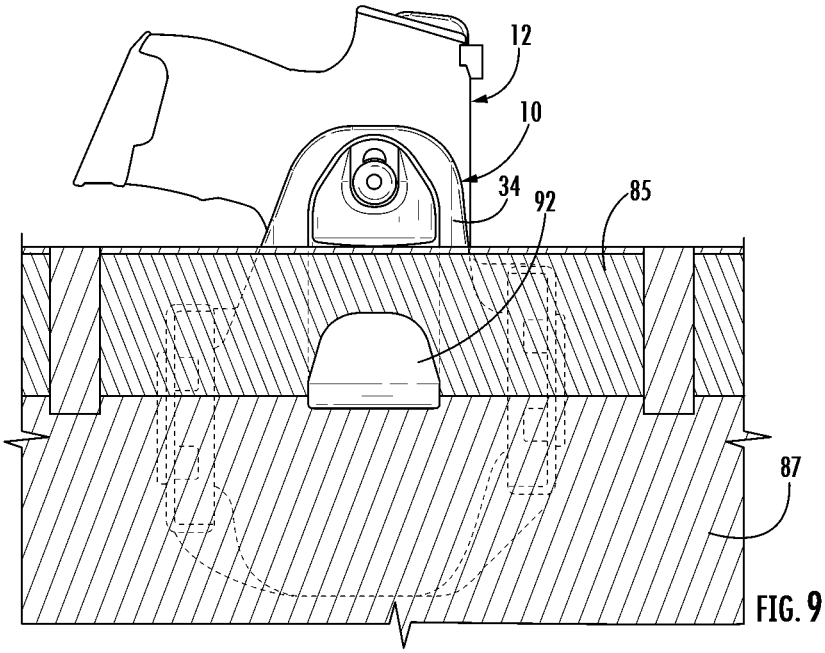
FIG. 9 is a schematic illustration of the holster being worn inside the waistband.
Figure 10:
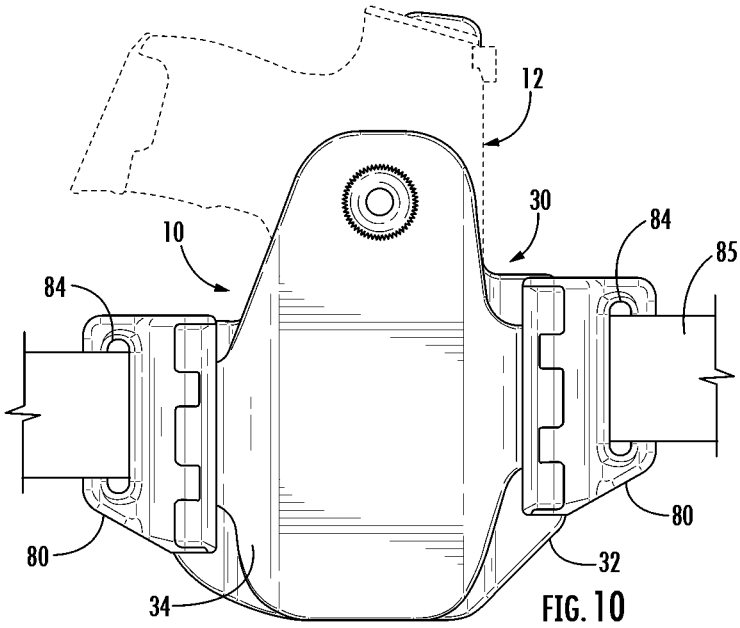
FIG. 10 is an illustration of the holster being worn outside the waistband.

For OWB usage, the holster body 30 is then complete, needing only to include the appropriate PRD as described below. For IWB usage, the J hook 92 mounts with a fastener 94 on a threaded insert of the holster body. As can be seen from FIG. 9, the J hook 92 receives the user's belt 85 to support the holster 10 on the belt. This is outside the waistband 87. The user's waistband 87 fits up inside the space between the J hook 92 and the second piece 34 (in FIG. 9, behind the J hook 92 but in front of the second piece 34.)

When the holster body 30 is thus assembled, the holster walls define a chamber 100 (FIG. 18) for receiving the pistol 12. The end of the holster body 30 that is opposite from the end wall 50 has an opening or entranceway 102 (FIG. 12) through which the pistol 12 may be inserted into the chamber 100, in an insertion direction 104 (downward as viewed in FIGS. 1 and 2). The pistol 12 may be removed or withdrawn from the chamber 100 in an opposite removal direction 106 (an upward direction as viewed in FIGS. 1 and 2). The bottom wall portion 48 of the holster body 30 has an edge adjacent to and partially defining the entranceway 102.

In accordance with a feature of the invention, as described below, the one holster body 30 will snugly accommodate and retain pistols 12 of different heights, even pistols 12 whose trigger guard 20 does not reach down to the bottom wall 48 of the holster 10. When the holster 10 has a top wall locking mechanism 38 as described above, the one holster can even accommodate and lock into place various pistols 12 of different heights. The holster chamber 100 can fit a large number (up to five or more) of pistols 12, and the PRD is provided as changeable part that allows the holster to easily change in order to fit and secure any one of the number of different pistols.

To this end, and in accordance with this feature of the invention, a plurality of different PRDs are provided, each of which (as described below) has the same mounting portion for mounting to the one holster body 30, but each having a different trigger guard engagement portion that is configured to retain a different pistol 12. As a result, the holster 10 can accommodate and retain different pistols 12, using just one holster body 30. The PRDs may be configured to provide vertical support to the bottom of the trigger guard 20, if necessary to support the pistol 12 snugly in the holster 10 and up against the top wall 46 of the holster body 30 to activate the handgun locking mechanism 38. For taller pistols 12 this may not be necessary, if the trigger guard 20 extends low enough to engage the bottom wall 48 of the holster 10. But for shorter pistols 12, the PRD has a portion that engages and supports the bottom of the trigger guard 20, as described below.

Figure 11:
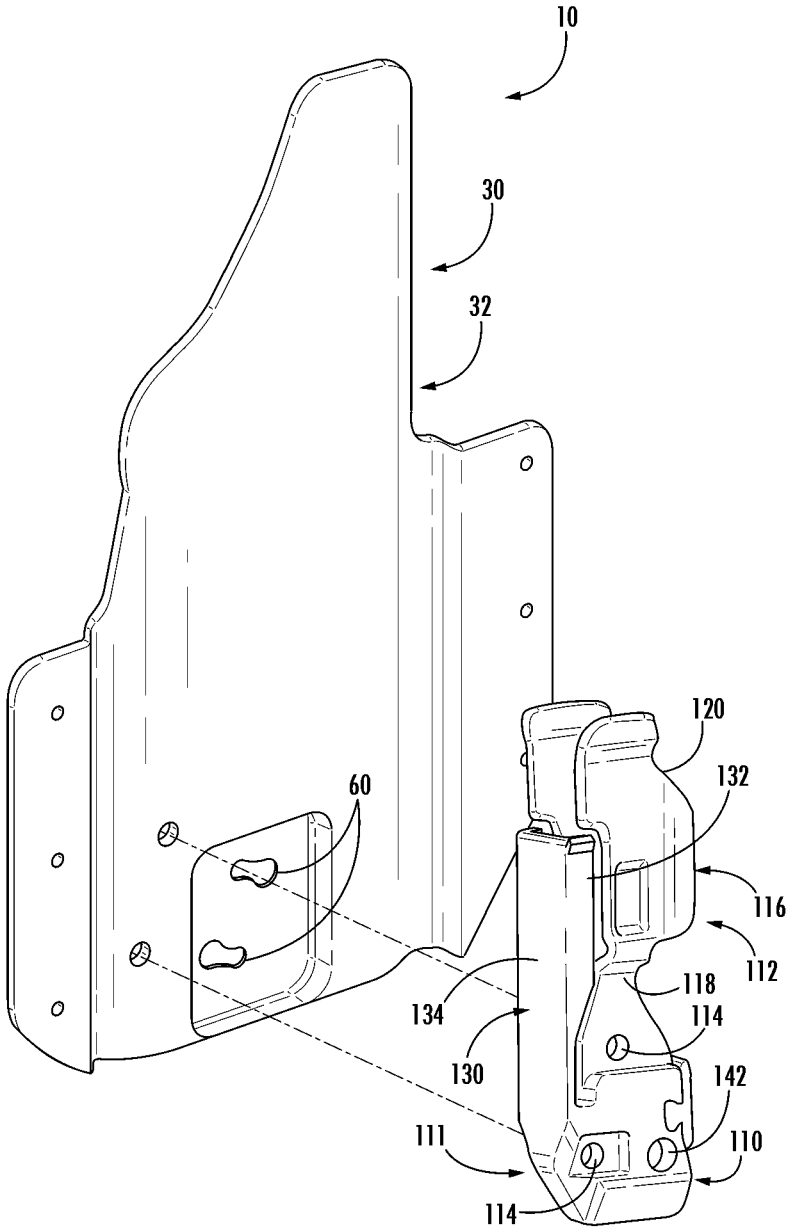
FIG. 11 is a schematic exploded perspective view illustrating the mounting of a generic pistol retention device, which forms part of the holster, on the holster body.

As noted, all the PRDs have a similar mounting portion for mounting to the holster body 30. This feature is illustrated in FIG. 11, which is a schematic exploded perspective view illustrating the mounting of a pistol retention device 111, which forms part of the holster 10, on the holster body 30. (Herein all the PRDs are numbered 111, even though they may be different in configuration.)

Specifically, the first piece 32 of the holster body 30 includes the two fastener openings 60 located near the bottom of the holster body 30. The PRD 111 has two main portions, specifically, a base or mounting portion 110, and a trigger guard engagement portion 112. There are two fastener openings 114 in the PRD mounting portion 110. To assemble the holster 10, the PRD 111 is placed in or associated with the unassembled holster body 30, before the first piece 32 is connected with the second piece 34. The fastener openings 114 in the PRD 111 line up with the fastener openings 60 in the first piece 32 of the holster body 30. Two suitable fasteners (for example, screws) 115 (FIG. 12) can then be used to secure the PRD 111 in position on the first piece 32. Then the second piece 34 of the holster body 30 can be joined to the first piece 32, with the PRD 111 secured between them.

If the holster body 30 is later disassembled, the fasteners 116 can be removed to release the PRD 111 from the holster body 30. This action enables replacement or repair of the PRD 111. This also action enables substitution of another, different, PRD that is configured to work with a different pistol 12. Each PRD that is used with the holster body 30 has same mounting portion configuration. As a result, the one holster body 30 can accommodate and secure a number of different PRDs in a working position inside the chamber of the holster 10, having different trigger guard engagement portions 112.

In each PRD 111, the trigger guard engagement portion 112 is configured for engaging the specific trigger guard 20 of a pistol that is positioned in the holster 10. The configuration of the engagement portion 112 is selected to provide the desired engagement with the trigger guard 20 of the particular pistol 12 that is being holstered, that is, the particular pistol 12 for which the PRD is designed. The engagement portion 112 typically includes two arms 116 having narrow central portions 118 extending from the mounting portion 110 and having wide end portions or paddles 120 to fit into the trigger guard opening 22. The arms 116 are flexible and resilient to enable the arms to be cammed out upon insertion of the pistol 12, when the trigger guard 20 is pushed between them, and then spring back with the paddles 120 moving into the trigger guard opening 22. As is evident from the different configurations of the paddles 120 in the three different PRDs 111 that are shown in FIGS. 12-17, the paddles of each PRD are configured to fit the trigger guard opening 22 of a specific pistol 12, many of which openings are quite different from each other.

Figure 14:
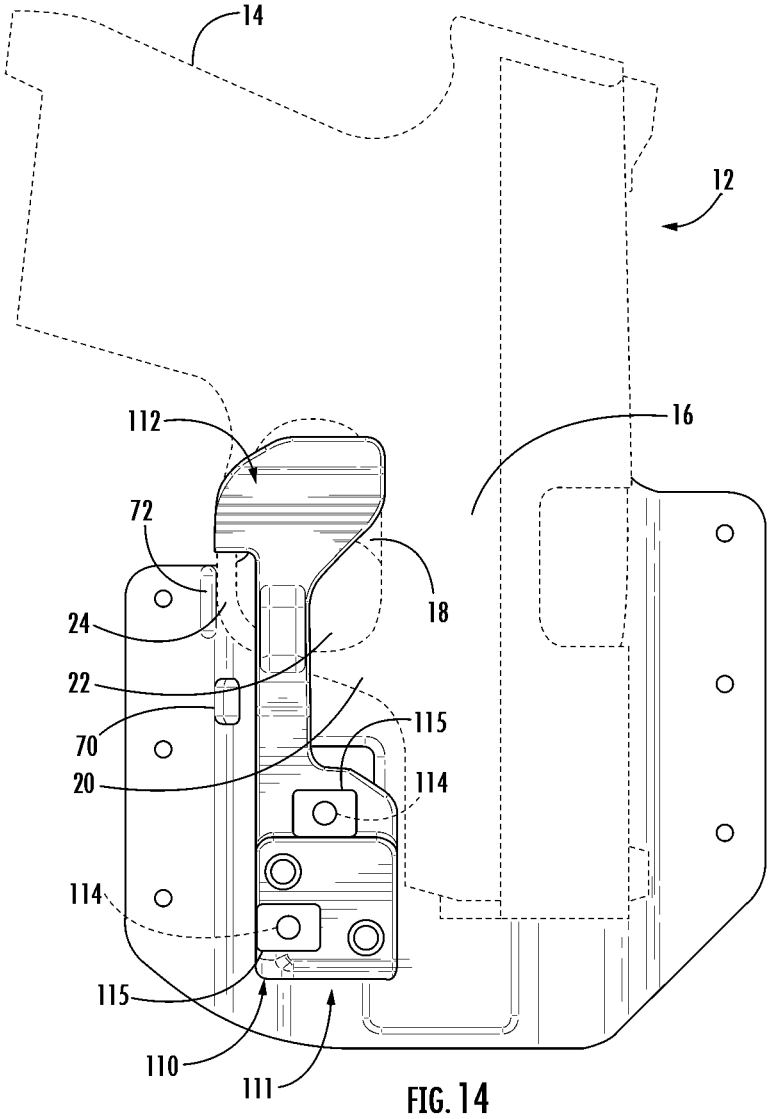
FIG. 14 is a partial schematic view of a holster of the invention showing mounted therein a second model of pistol retention device
Figure 15:
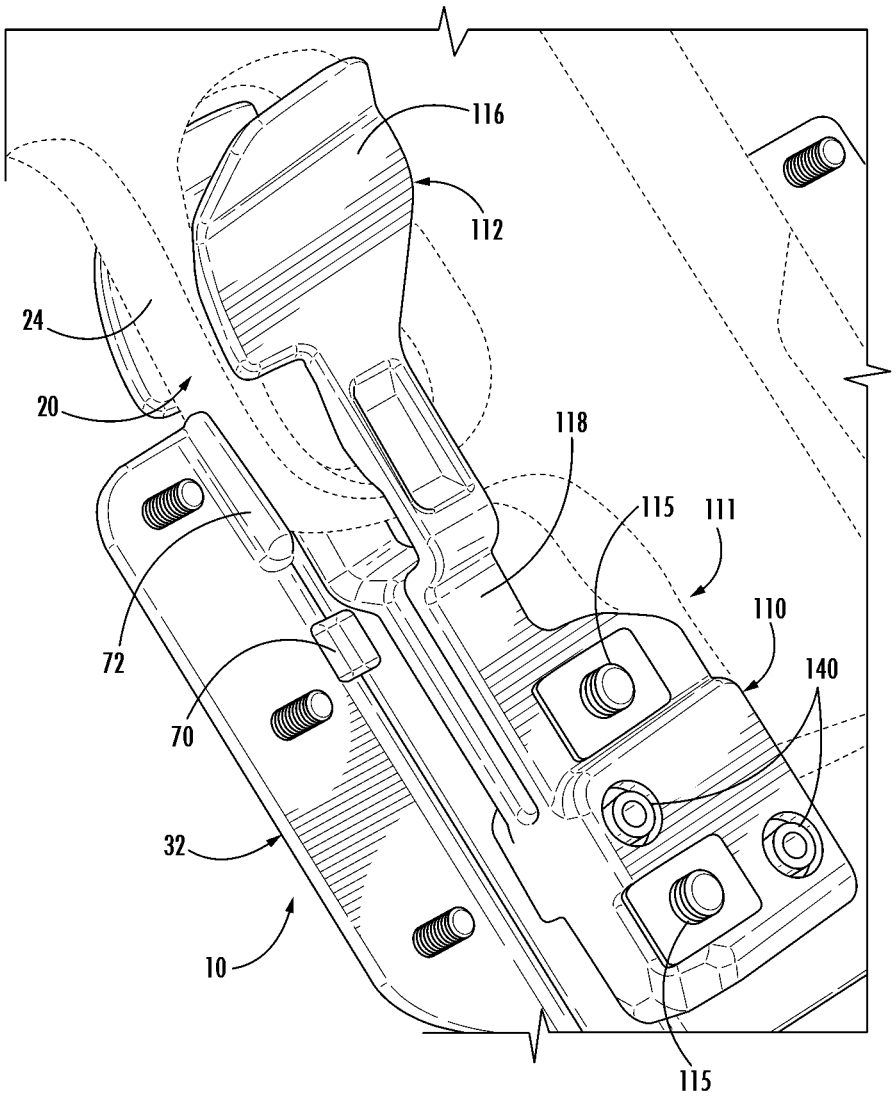
FIG. 15 is a perspective view of the holster and pistol retention device of FIG. 14.
Figure 16:
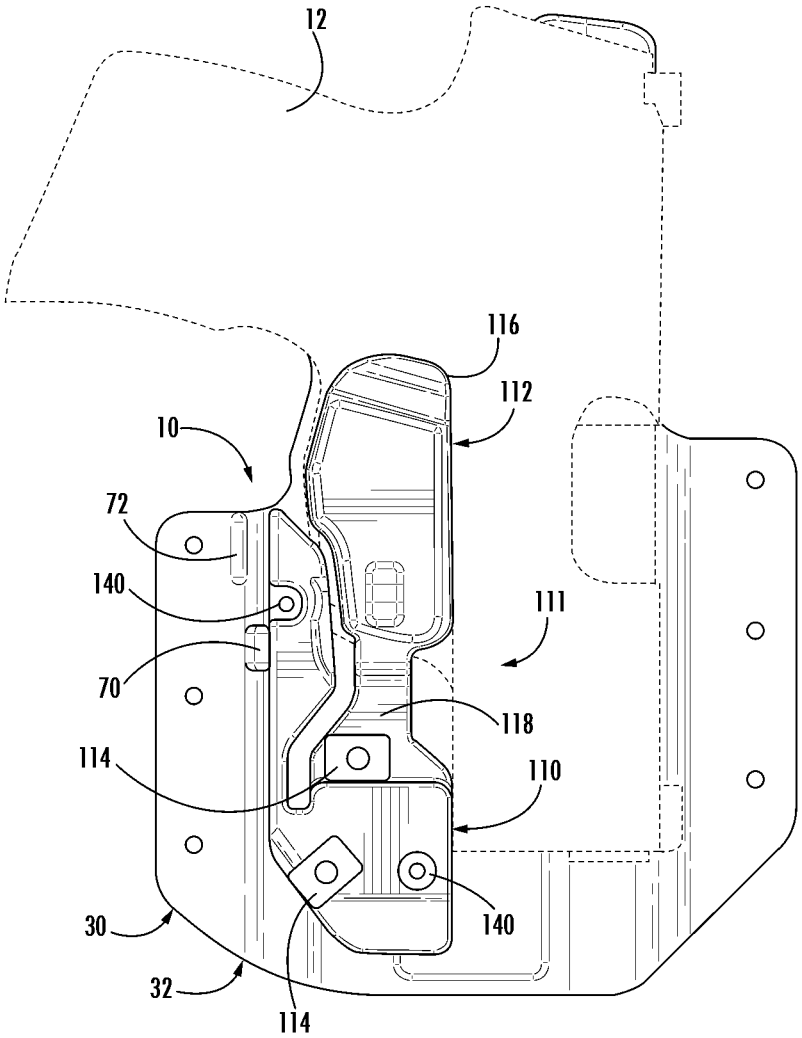
FIG. 16 is a partial schematic view of a holster of the invention showing mounted therein a second model of pistol retention device.
Figure 17:
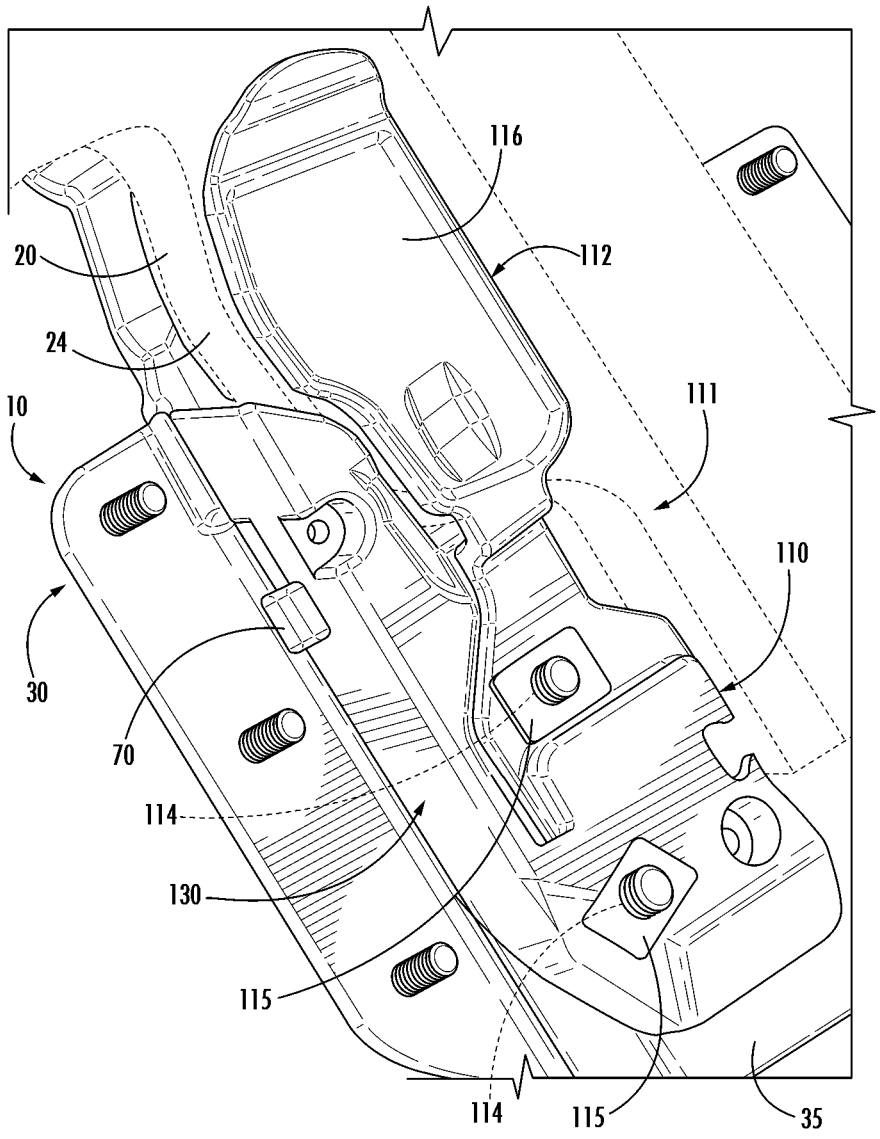
FIG. 17 is a perspective view of the holster and pistol retention device of FIG. 16.

Some of the PRDs 111 also include a bottom arm 130. If the particular pistol 12 that is being holstered is tall enough that it can engage the bottom portion 48 of the holster body 30, the PRD 111 that is used does not include a bottom arm 130. In that case, the trigger guard 20 of the pistol 12 engages the rearward tab 72 of the holster body bottom portion 48, as shown in FIGS. 14 and 15, for example, when the pistol 12 is inserted into the chamber 100. This engagement supports the trigger guard 20 of the pistol 12 and thus supports the pistol 12 upward in the holster 10, against the locking mechanism 28 on the top portion 46 of the holster.

In contrast, if the particular pistol 12 that is being holstered is not tall enough to simultaneously engage both the rearward tab 72 of the holster body 30 and the top wall 46 of the holster body 30, a PRD 111 that is selected will include a bottom arm 130. The generic PRD 111 illustrated in FIG. 11 includes a bottom arm 130, as do the PRDs 111 that are shown in FIGS. 12-13 and FIGS. 16-17. The bottom arm 130 is a portion of a PRD 111 that projects rearward from the mounting portion 110 (in a direction toward the entranceway 102), at a location below the trigger guard engagement portion 112 of the PRD. The bottom arm 130 preferably has a U-shaped cross-sectional configuration (as seen in FIG. 18, for example), to wrap around the trigger guard 20, this configuration including two side walls 132 and a bottom wall 134 that engages the bottom leg 24 of the trigger guard 20.

When a PRD 111 with a bottom arm 130 is mounted in the holster body 30, the bottom arm of the PRD rests on the forward tab 70 of the holster bottom portion 48. When a pistol 12 is inserted in the chamber 100 of the holster 10, the bottom leg 24 of the trigger guard 20 enters into the U-shaped bottom arm 130 of the PRD 111. The dimensions of the bottom arm 130 (specifically, the wall thickness of the bottom wall 134 of the bottom arm) are selected so that the bottom arm of the PRD 111 is firmly captured (vertically) between the forward tab 70 on the holster body 30, and the trigger guard 20 of the pistol 12. This engagement supports the pistol 12 securely upward against the locking mechanism 28 at the top of the holster 10. In this way, even though the pistol 12 is not itself tall enough (when in the holster body 30) to accomplish this locking mechanism engagement, adding the particularized PRD 111 to the holster body 30 produces this result. This wall thickness can be different between one PRD 111 and another, to accommodate different height pistols 12. And this upward positioning can help to provide a snug fit of the pistol 12 in the holster 10, even when a locking mechanism does not need to be engaged.

For ease of manufacturing, the PRD 111 may be made from two longitudinally extending parts that are riveted together. If no bottom arm 130 is used, then two rivets 140 are provided that extend through rivet openings 142 in the mounting portion 110 of the PRD 111, for example, as shown in FIGS. 14 and 15. If the PRD 111 does include a bottom arm 130, only one rivet 140 is used in the mounting portion 110 of the PRD, and the other rivet extends through the bottom arm 130 of the PRD to hold the two molded halves of the PRD bottom arm together.

This latter circumstance can be embodied in two different configurations. First, if the PRD bottom arm 130 is tall enough (thick enough), as in the embodiment of FIGS. 16 and 17, the rivet 140 can extend directly through the bottom arm. Second, if the PRD bottom arm 130 is not tall enough to receive the rivet 140, then a rivet socket can be provided (as shown at 144 in the embodiment of FIGS. 12 and 13) that extends below the U-shaped portion of the bottom arm. In either case, the bottom wall 134 of the bottom arm 130 engages on the forward tab 70, as seen in FIGS. 12-13 and 16-17, to support the bottom arm and thereby support the trigger guard 20 of the pistol 12.

It can thus be seen that the invention provides a common mounting portion for multiple different PRDs; unique trigger guard engagement portions for the multiple different PRDs; and if necessary a bottom arm to support a shorter pistol—with the bottom wall of the bottom arm having different selected thicknesses. Thus, the single holster body is able to accommodate a number of different pistols having varying sizes and configurations; and the holster can be customized for each pistol, by using a customized PRD. In addition, this feature can be used when the holster is configured either as an IWB holster or as an OWB holster.

The invention claimed is:

1. A holster for a pistol that has a top portion and that has a bottom portion including a trigger guard, the holster comprising:

a holster body having a top portion and a bottom portion fixed in position relative to the top portion, the holster body defining a chamber in the holster body for receiving a portion of the pistol;

the holster body being made of two holster body pieces that are joined together to form the holster body defining the chamber; and a plurality of different pistol retention devices each of which is configured to be mounted inside the chamber of the holster body between the at least two holster body pieces;

each one of the plurality of devices having a mounting portion for securing the device in the chamber of the holster body and having a trigger guard engagement portion for releasably engaging the trigger guard of the pistol;

the mounting portions of the plurality of devices being substantially identical to each other whereby any selected one of the plurality of devices can be similarly mounted in a working position inside the chamber of the holster body;

the trigger guard engagement portions of the plurality of devices being substantially different from each other thereby to properly releasably engage different pistols having different trigger guards;

whereby the one holster body can accommodate and retain a number of different pistols having different sizes and configurations by mounting an appropriate pistol retention device that is configured for that pistol wherein the holster body bottom portion includes:

a first tab configured and positioned for engagement by the bottom of the trigger guard of a pistol that is in the chamber, thereby to urge the pistol upward toward the top portion of the holster; and a second tab configured and positioned for engagement by a bottom arm of a pistol retention device that is mounted in the holster body chamber, thereby to urge the pistol upward toward the top portion of the holster;

the positioning of the first and second tabs on the holster bottom portion being selected to enable a taller pistol to engage the first tab and a shorter pistol to engage the bottom arm of the pistol retention device.

2. A holster as set forth in claim 1 wherein the wall thickness of a bottom leg of the bottom arm of the pistol retention device is selected to fit a particular pistol so that the overall distance between the bottom leg and the top portion of the holster is thereby adapted to snugly accommodate a particular pistol having a particular height.

3. A holster as set forth in claim 1 wherein the first tab is disposed on the bottom portion of the holster body in a location closer to an entranceway of the chamber than the second tab.

4. A holster for a pistol that has a top portion and that has a bottom portion including a trigger guard, the holster comprising:

a holster body having a top portion and a bottom portion fixed in position relative to the top portion, the holster body defining a chamber in the holster body for receiving a portion of the pistol;

the holster body being made of two holster body pieces that are joined together to form the holster body defining the chamber; and a plurality of different pistol retention devices each of which is configured to be mounted inside the chamber of the holster body between the at least two holster body pieces;

each one of the plurality of devices having a mounting portion for securing the device in the chamber of the holster body and having a trigger guard engagement portion for releasably engaging the trigger guard of the pistol;

the mounting portions of the plurality of devices being substantially identical to each other whereby any selected one of the plurality of devices can be similarly mounted in a working position inside the chamber of the holster body;

the trigger guard engagement portions of the plurality of devices being substantially different from each other thereby to properly releasably engage different pistols having different trigger guards;

whereby the one holster body can accommodate and retain a number of different pistols having different sizes and configurations by mounting an appropriate pistol retention device that is configured for that pistol wherein some but not all of the plurality of devices have a bottom arm for engaging the bottom of the trigger guard of a pistol that is in the chamber, and others of the plurality of devices do not have a bottom arm for engaging the bottom of the trigger guard of a pistol that is in the chamber.

5. A holster for a pistol that has a top portion and that has a bottom portion including a trigger guard, the holster comprising:

a holster body having a top portion and a bottom portion fixed in position relative to the top portion, the holster body defining a chamber in the holster body for receiving a portion of the pistol;

the holster body being made of two holster body pieces that are joined together to form the holster body defining the chamber; and a plurality of different pistol retention devices each of which is configured to be mounted inside the chamber of the holster body between the at least two holster body pieces;

each one of the plurality of devices having a mounting portion for securing the device in the chamber of the holster body and having a trigger guard engagement portion for releasably engaging the trigger guard of the pistol;

the mounting portions of the plurality of devices being substantially identical to each other whereby any selected one of the plurality of devices can be similarly mounted in a working position inside the chamber of the holster body;

the trigger guard engagement portions of the plurality of devices being substantially different from each other thereby to properly releasably engage different pistols having different trigger guards;

whereby the one holster body can accommodate and retain a number of different pistols having different sizes and configurations by mounting an appropriate pistol retention device that is configured for that pistol further including:

a first pair of clamps without belt loops for joining the first holster body piece to the second holster body piece thereby to create an inside the waistband configuration of the holster;

a second pair of clamps different from the first clamps for joining the first holster body piece to the second holster body piece thereby to create an outside the waistband configuration of the holster, the second pair of clamps including belt loops.

6. A holster as set forth in claim 5 further including a J-hook secured to the assembled holster body for engagement with a belt of a user.

7. A method of assembling a holster for a selected pistol, the method comprising the steps of:

providing a first holster body piece;

providing a second holster body piece that can be joined to the first holster body piece to form a holster body having a chamber therein for receiving the selected pistol;

providing a plurality of different pistol retention devices that can alternatively be mounted in the chamber of the holster body;

selecting a pistol retention device that is configured to help to support the selected pistol snugly in the chamber;

mounting the pistol retention device to the first holster body piece;

providing two pairs of clamps that can alternatively be used to join the first holster body piece to the second holster body piece in either an inside the waistband configuration or an outside the waistband configuration;

selecting the desired pair of clamps; and joining the first holster body piece to the second holster body piece with the selected pair of clamps, with the pistol retention device already being mounted to the first holster body piece.

8. A method as set forth in claim 7 further including the step of securing a J-hook to the assembled holster body for engagement with a belt of a user.

* * * * *